US005888152A

United States Patent [19]

Rogers et al.

[11] Patent Number: 5,888,152

[45] Date of Patent: Mar. 30, 1999

[54] GAUNTLET ATHLETIC TRAINING SLED AND METHODS OF USING AND CONSTRUCTING IT

[75] Inventors: Orley D. Rogers, Farwell; Kenneth E. Staten, Clare; Edwin A. Hallberg, Midland, all of Mich.

[73] Assignee: Rogers Athletic Company, Clare, Mich.

[21] Appl. No.: 918,124

[22] Filed: Aug. 27, 1997

[51] Int. Cl.[6] ..... A63B 69/00

[52] U.S. Cl. ..... 473/440

[58] Field of Search ..... 473/440, 441

[56] References Cited

U.S. PATENT DOCUMENTS

| | | | |
|---|---|---|---|
| D. 313,638 | 1/1991 | Gilman . | |
| 1,436,846 | 11/1922 | Willimann | 473/440 |
| 1,762,435 | 6/1930 | Brett | 473/440 |
| 1,916,385 | 7/1933 | Oakes | 473/440 |
| 2,237,600 | 6/1941 | Gilman . | |
| 2,620,188 | 4/1952 | Malagio . | |
| 2,653,816 | 7/1953 | Young et al. . | |
| 2,752,155 | 6/1956 | Nedwick . | |
| 3,304,089 | 2/1967 | Smith . | |
| 3,365,947 | 1/1968 | Jamich | 473/441 |
| 3,377,064 | 4/1968 | Hudson et al. | 473/440 |
| 3,390,336 | 6/1968 | Spearman | 473/441 |
| 3,451,677 | 6/1969 | Nedwick . | |
| 3,458,192 | 7/1969 | Trice | 473/441 |
| 3,999,755 | 12/1976 | Shealy, Jr. . | |

*Primary Examiner*—Theatrice Brown

*Attorney, Agent, or Firm*—Reising, Ethington, Learman & McCulloch, PLLC

[57] ABSTRACT

A gauntlet athletic sled for use by football trainers has a sled frame with spaced apart side sections defining a runway between them from a front end to a rear end. A front to rear extending series of readily removable, position adjustable inflated resilient arms project from the side sections laterally into the runway to create a predetermined obstacle path simulating the arms and hands of would be tacklers, which must be deflected aside to permit passage of the runner down the pathway. The varied pressure of arm inflation controls the resistance to passage of the runner proceeding down the runway.

13 Claims, 3 Drawing Sheets

FIG-4
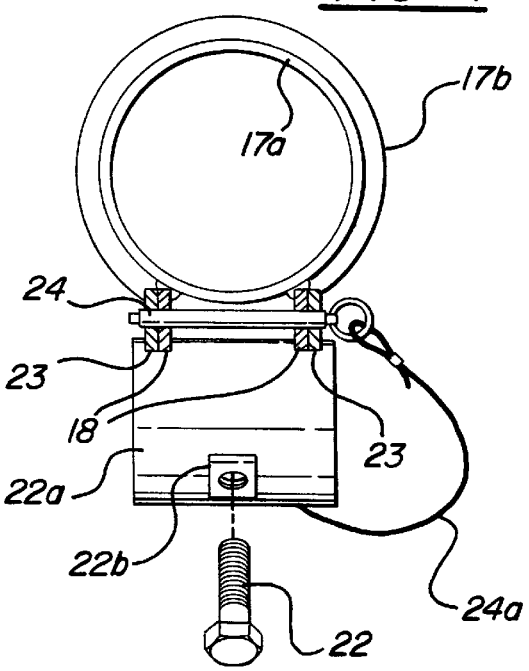
FIG-6
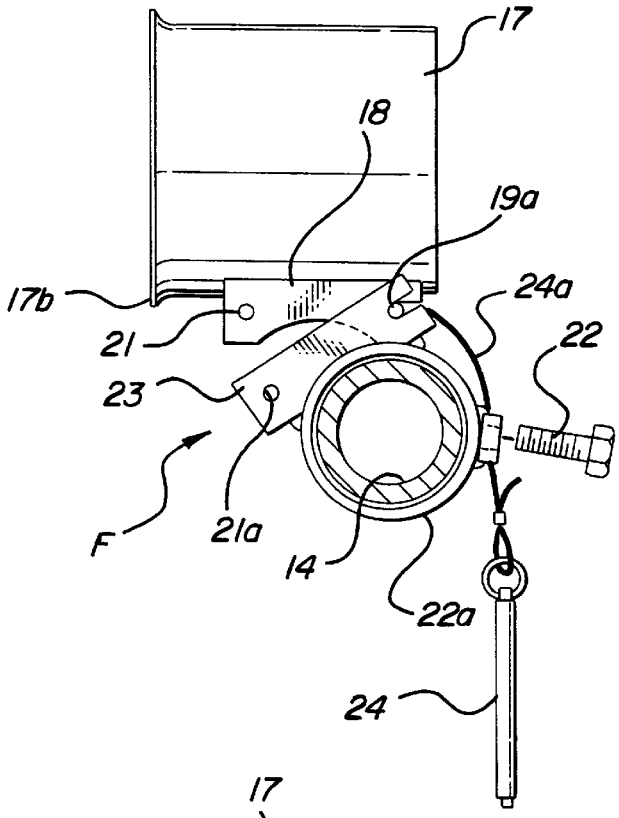
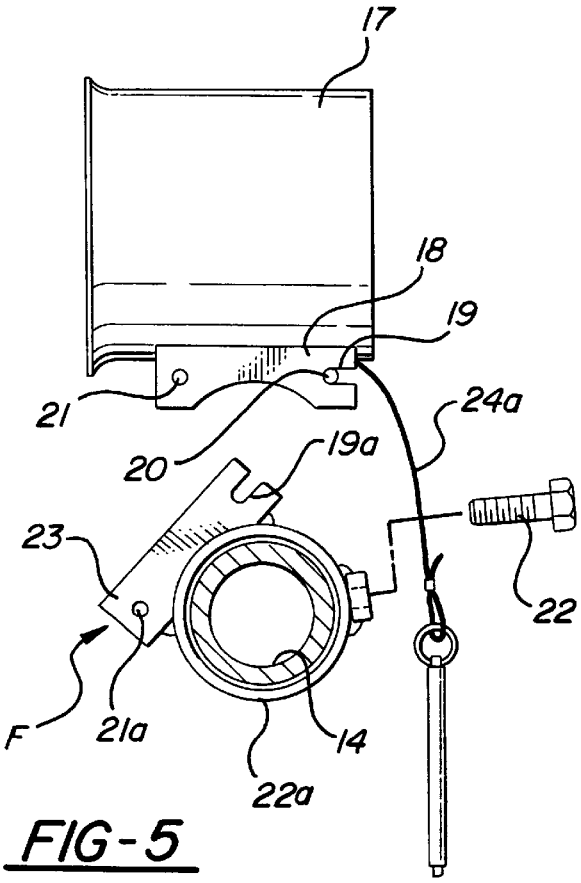
FIG-5
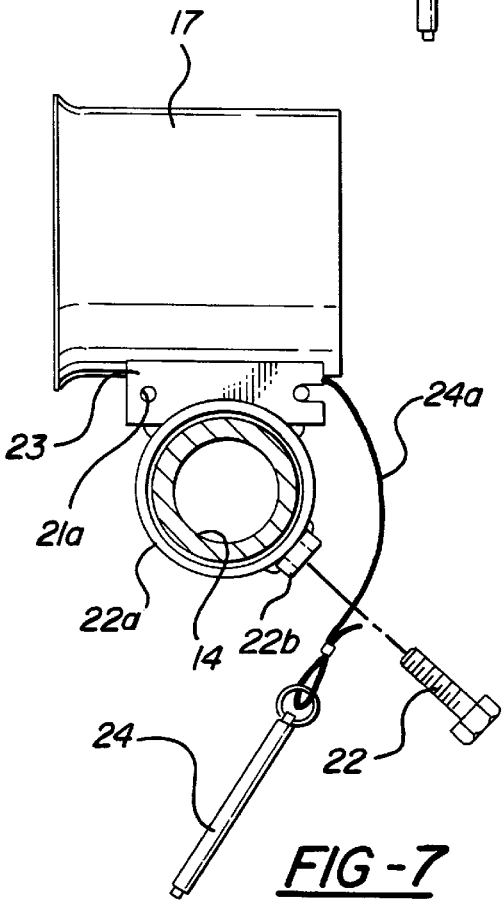
FIG-7

GAUNTLET ATHLETIC TRAINING SLED AND METHODS OF USING AND CONSTRUCTING IT

The gauntlet sled of the present application relates to training sleds for use in training football running backs and others, and defines a runway or aisle with projecting obstacles simulating the arms of would be tacklers

BACKGROUND OF THE INVENTION

Gauntlet sleds of the general character indicated have been in use for some time, and are exemplified in U.S. Pat. Nos. 3,451,677 and 2,752,155. Responsive to the forward motion of the runner, the projecting obstacle arms are deflected aside to permit the runner to pass, and then spring back to the original position.

The present improvement deals with the concept of providing inflatable, resilient obstacle arms which project randomly into the runway in staggered formation at different heights, angles, and intervals, to simulate opponents tackling the legs and upper body of the runner, and opponents seeking to strip the ball from the arms of the runner. Unlike the prior art spring-biased arms, which have less resistance when the player passes the spring's load point and tend to create pinch points which could injure the runner, the air-filled arms of the present construction put consistent pressure on the ball carrier and are capable of movement in all directions for added safety and realism. The inflatable arms are provided with unique fittings for releasably attaching them to the frame side rails in a manner to permit the height, the angle of projection, and the interval between arm sets or splits to be adjusted to closely simulate anticipated game day conditions.

One of the prime objects of the present inventions is to provide an improved gauntlet sled of the character described which can be used to train running backs and their lead blockers, in particular, to pump their legs while exploding through holes and maintaining balance.

Still another object of the invention is to provide a gauntlet sled wherein one-piece, inflatable, resilient arms, with no mechanical components, provide the consistent resistance necessary to simulate game-day play in a manner which avoids injury.

A further object of the invention is to provide a gauntlet construction of the character described wherein tension or resistance to passage is adjustable by the simple expedient of varying air pressure, and mechanical pinch points, which might cause injury, are avoided.

Still a further object of the invention is to provide an inflatable arm gauntlet sled in which the inflatable arms have inflated and deformable fist-like ends simulating the grabbing action of would-be opponent tacklers when encountered by the runner.

A further object of the invention is to provide an inflatable arm which can be bent about a relatively rigid arm mount sleeve which has the dual function of adjustably supporting the arm on a gauntlet sled side rail.

Still a further object of the invention is to provide an inflatable arm mount with interlocking fittings which provide for quick detachment of the arm and its carrier for storage without disassembly of the sled.

Another object of the invention is to provide a very durable, well stabilized gauntlet sled of the type described which is economical to manufacture and assemble, and to maintain.

Other objects and advantages of the invention will become apparent with reference to the accompanying drawings and the accompanying descriptive matter.

THE DRAWINGS

In the drawings:

FIG. 4 is a partly exploded rear end elevational view of the arm fitting only, with the interlocking parts of the fitting shown in locked position;

FIG. 5 is an exploded side elevational view with the interlocking parts shown in disengaged position;

FIG. 6 is a view similar to FIG. 5 illustrating the first step in the interengagement of the interlocking parts; and FIG. 7 is a view similar to FIGS. 4–6 showing the fitting parts in interlocking position ready to be secured by a locking pin.

DESCRIPTION OF THE PREFERRED EMBODIMENT

Figure 1:
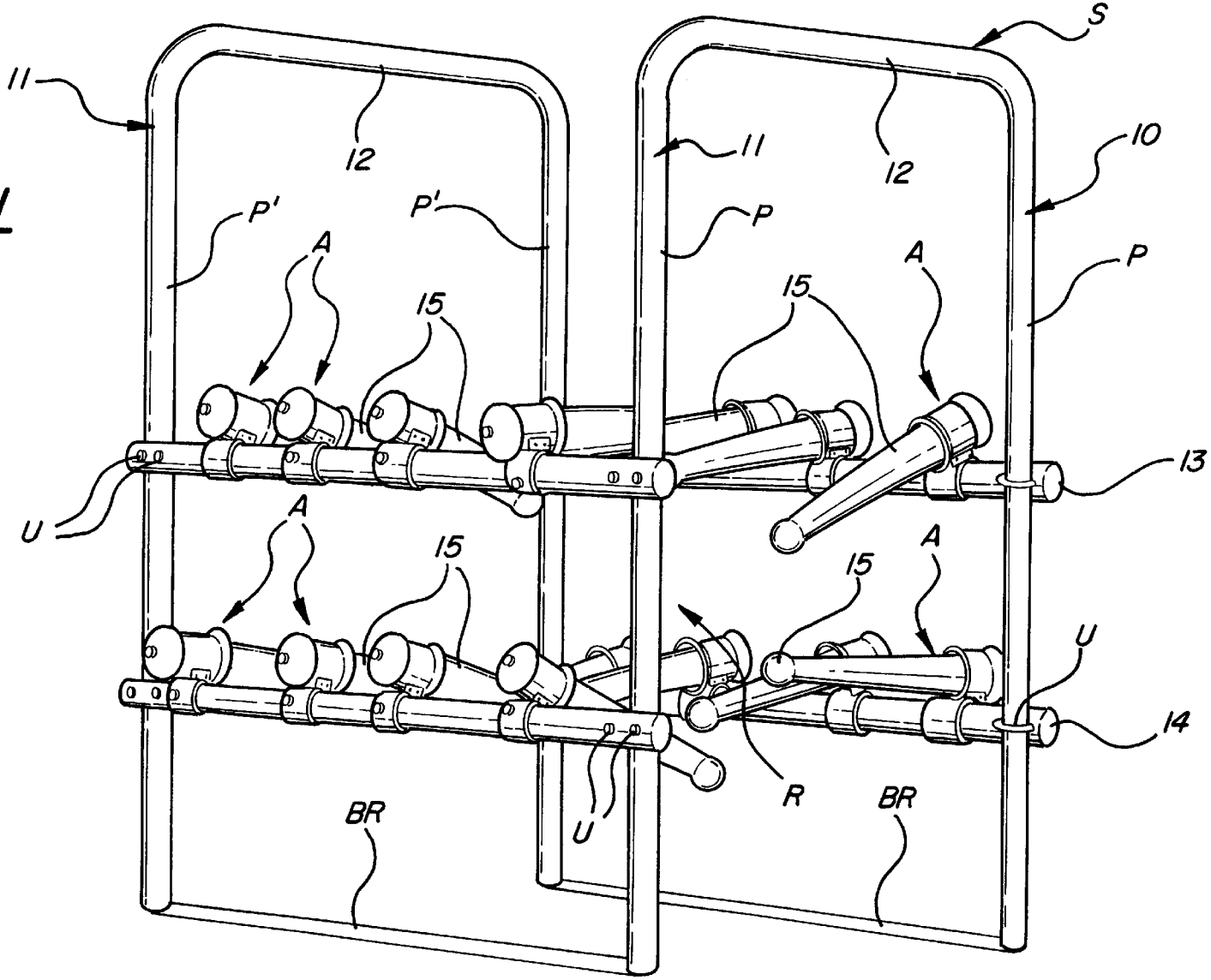
FIG. 1 is a perspective side elevational view of the gauntlet sled frame and associated arm assemblies only.
Figure 2:
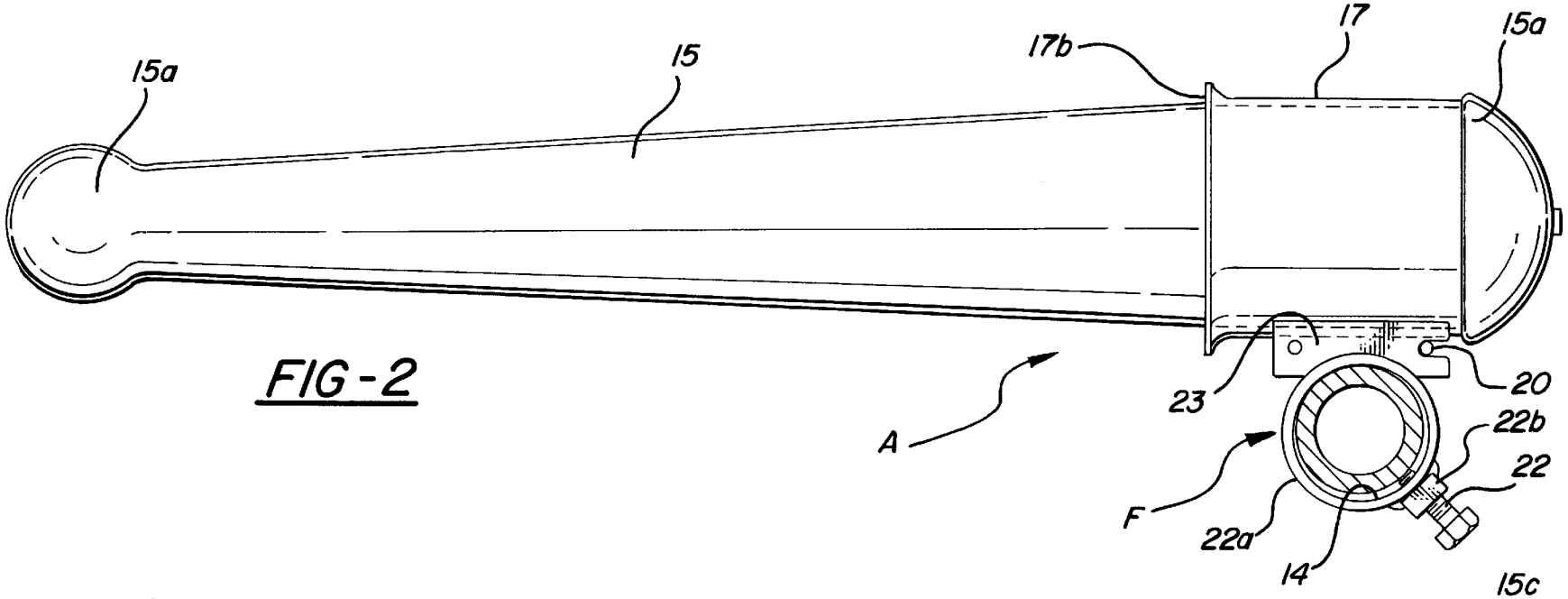
FIG. 2 is an enlarged side elevational view of one of the arm members, with its mount fitting shown clamped in position on one of the side frame side rails.

Referring now more particularly to the accompanying drawings, and in the first instance to FIG. 1, the gauntlet sled, generally designated S, is shown as comprised of a frame system having spaced apart rectangular side frames or sections;, generally designated 10 and 11, which include front and rear vertical posts P and P' connected at their front and rear ands by integral side frame unifying upper cross pieces 12. The side frames 10 and 11 further incorporate post-spanning, front to rear extending upper and lower rods or rails 13 and 14, as shown, and it is on these tubular rods or pipes 13 and 14 that the arm assemblies, generally designated A in FIGS. 1 and 2, are mounted. Runners or bottom rails designated BR are provided to further connect the lower ends of the side posts P and P' to which the side rails 13 and 14 are vertically adjustably connected by U-bolts U, or the like, for example.

Figure 3:
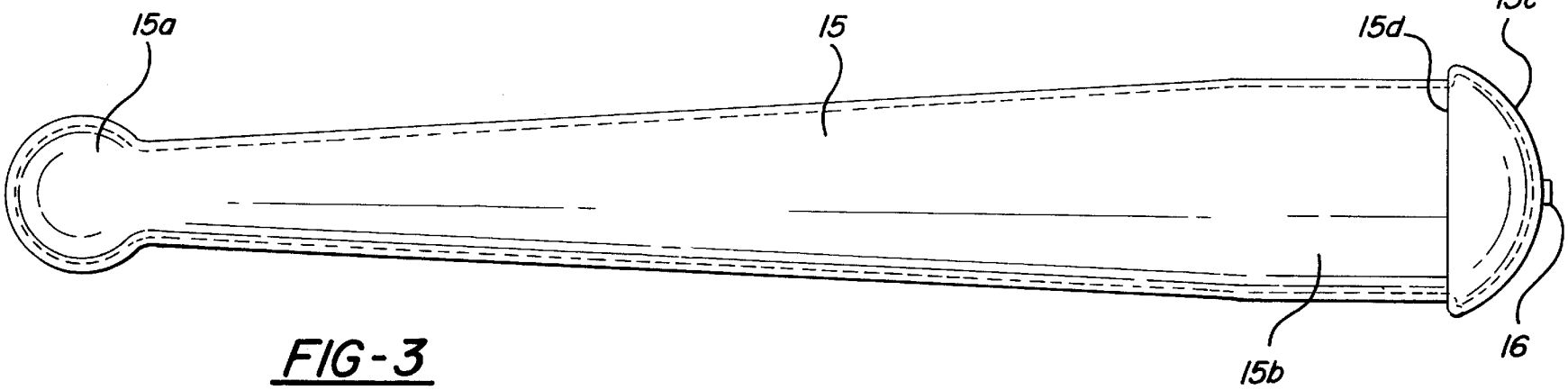
FIG. 3 is a top plan view of the inflatable arm only.

The arm assemblies A, which are shown mounted on the rails 13 and 14 to project into the aisle or runway R defined between the side rails 13 and 14 provided on the side frames 10 and 11 comprise hollow, inflatable, air-filled, elastic synthetic plastic bladders which have fist-shaped front ball portions 15*a* and cylindrical portions 15*b* which terminate in rounded cup-shaped cap portions 15*c*. Between the front end ball portions 15*a* and generally cylindrical portions 15*b*, the arms 15 diverge or taper, as indicated in FIGS. 2 and 3, and it will be noted that the rear end caps 15*c* are of enlarged annular girth to provide an annular arm shoulder 15*d*. A conventional valve 16, which permits inflation or deflation of the arm 15, is provided for each cap 15*c* and may be of the depressible plunger type conventionally utilized on automotive tires. Typically, the elastomer used for arms A may be polyvinyl chloride, but other synthetic plastics are also contemplated.

A metal sleeve, which is sufficiently rigid to mount the arm 15, fits over the arm portion 15*b* to abut against shoulder 15*d*, and dependently carries a pair of spaced apart interlock plates 18. The plates 18 are provided with slots 19 in their rear portions and pins 20 are fixed or welded in place in the slots 19 as shown. The front ends of plates 18 are provided with transversely aligned openings 21.

The sleeve 17 and plates 18 are part of a disengagable fitting, generally designated F, which is movable along one of the frame rods or pipes 13 or 14, and is secured in position by a set screw 22 in a selected longitudinal position, and at a preferred angle of projection. The sleeve 22*a,* which is part of fitting F, is clamped to a side rail 13 or 14 by the set screw 22, which operates in conjunction with a fixed nut 22*b* fixed to the sleeve 22*a*. Provided on each sleeve 22*a* are a like pair of interlock plates 23 which are spaced apart as shown in FIG. 4 to lie outboard of the plates 18 in facial engagement therewith when the interlock parts are in the assembled position. The plates 23 are provided with matching rear slots 19*a* and front pin openings 21*a* and, as shown in FIGS. 4 and 7, the plates 23 are received on the pins 20 via the slots 19*a*. A retaining pin 24 is utilized to extend through openings 21 and 21*a* to retain the sleeve 22*a* secured to sleeve 19, and a pin retention line 24*a* may be provided for the pin 24 and can secure to one of the plates 18. In view of this construction involving the interlocking plates 18 and 23, a quick detachment of each arm A and its sleeve 17 is possible for storage purposes without disassembly of the whole unit, and the construction also facilitates replacement of one of the arms 15 when necessary.

As FIG. 1 particularly indicates, the arms 15 randomly angularly project in staggered relation into the path of the running back or other runner who must move them aside against the air pressure in the arms 15 and bend them rearwardly about the flared front 17*b* of the sleeve 17 as the player proceeds along the aisle or runway R between frames 10 and 11. With the bending of the air-filled arms 15 taking place about the flared edges 17*b* of the sleeves 17, no mechanical pinch points are created, which could injure the trainee.

THE OPERATION

The arms A on each side are randomly mounted in the sense that they project into the runway R at different angles and at differently longitudinally spaced positions along the runway R so contact does not occur in the same spot. The upper arms 15 on side rails 13 are normally located somewhat below the shoulder level position of the player to simulate tackler's arms projecting into the ball carrying area. The arms 15 on the lower rails 14 may project at different angles into a path to embrace the thighs or calves of the runner, or some may project downwardly sufficiently toward the ankles of the runner to seek to trip him. The rails 14 can be moved downwardly, on pipes P and P', to accommodate this latter positioning of the arms 15 at one or more arm positions along the runway R. The fist-like ends 15*a* simulate the grabbing action of would be tacklers who are tackling the ball, and teach the runner to protect the ball and avoid stripping of the ball.

The air filled arms put consistent pressure on the ball carrier as he moves forcefully along the runway R and the arms, because of their randomly staggered positions, move in all directions for added safety and realism. Trainees are taught to pump the legs, cover the ball, and make the second effort as they move along the gauntlet sled runway. Not only running backs benefit from use of the sled. Linemen can also be trained to "break the hole" for the backs, and blocking dummies can be used as an attachment for the sled to facilitate this practice wherein the linemen and running backs practice hitting, spinning, and running through the runway, or rip, swim, and run-through techniques.

The pressure of inflation of the arm 15 controls the resistance to passage of the runner proceeding down the runway, and is varied to create the obstacle path which is desired by the coach. Further, the angle of projection of the arms A and the spacing or splits between arms is selected by the coach to build the obstacle path he wishes to create. The spacing between frames 10 and 11 is sufficient so that the runner can veer and react to the varied air pressure encountered in the arms along the obstacle path. A greater or lesser resistance to passage is imposed on the runner, depending on whether the runner contacts the front ends of the arms 15 or engages the larger girth portions of the arm 15 which are nearer to the arm bend points at 17B. Because of the air pressure within the arms 15, which typically will vary within the range of 5 to 20 psi, the runner must explode through the runway R, the pressure normally being such that a runner would be trapped and stopped if he were not blasting through at full speed. The arms 15 resiliently snap back to the original position, once the runner has passed and released them. As shown in FIG. 1, the arms A project more or less downwardly dependent on the obstacle path desired, to train runners to pump their legs, blast through holes, and maintain balance, all while carrying the ball properly to resist stripping.

It is to be understood that the disclosed embodiment is representative of a presently preferred form of the invention, but is intended to be illustrative rather than definitive thereof. The invention is defined in the claims.

We claim:

1. In a gauntlet athletic sled for use in training football running backs and others;

a. a sled frame system having spaced side sections defining a runway between them from a front end to a rear end; and b. a front to rear extending series of inflated resilient arms projecting from said side sections laterally into said runway to create an obstacle path simulating the arms of would be tacklers, the pressure of inflation controlling the resistance to passage of the runner proceeding down the runway.

2. The sled of claim 1 wherein said arms have inner ends with generally ball shaped terminal protrusions, of greater girth than said inner ends, which tend to strip the ball from the runner's grasp.

3. The sled of claim 2 wherein said inflatable arms diverge gradually from said inner ends to generally cylindrical portions which join to cap outer ends having inflation valves therein.

4. The sled of claim 3 wherein said arms project from rigid arm mount sleeves receiving them adjacent their outer ends, the caps being of greater girth to provide shoulders on said arms for abutting said mount sleeves which have dependent fittings thereon; said frame side sections having front to rear extending rails on which said fittings are received.

5. The sled of claim 4 wherein said fittings include a releasable lock part on the arm mount sleeve, a rail mount, and a lock part on the rail mount interlocking with said lock part on the arm mount sleeve.

6. The sled of claim 5 wherein said lock part on the arm mount sleeve comprises a first pair of spaced apart front to rear latch plates joined by a pin; the lock part on the rail mount including a second pair of plates having open ended slots for receiving said pin; said lock parts on the arm mount sleeve and rail mount being further provided with alignable openings and a releasable lock pin which is inserted through said openings.

7. The sled of claim 6 wherein said rails are of generally cylindrical cross-section and said rail mounts are sleeves slidably and pivotally received on said rails; said pair of plates on the rail mounts being spaced apart to fit in facial abutting engagement within the pair of plates on the arm mount sleeves; and set screw clamps releasably provided on said rail mounts for releasably securing them and said arms in random position on said guide rails.

8. The sled of claim 1 wherein said frame side sections have front to rear extending rails and said arms have rail mounts at their outer ends which are slidably received on said rails and have fasteners for releasably securing said arms on said rails.

9. The sled of claim 8 wherein said rails are of generally cylindrical cross-section and said rail mounts include sleeves slidably and rotatably received on said rails.

10. A method of constructing a gauntlet athletic sled comprising a sled frame system having spaced side sections defining a runway between them from a front end to a rear end comprising the steps of:

a. mounting a front to rear extending series of inflated resilient arms on the frame system to project into the runway to create an obstacle path simulating the arms of would be tacklers; and b. inflating said arms with sufficient gaseous pressure to cause said arms to resist passage of the runner, yet bend aside to permit the runner to pass, and then spring back to original position.

11. The method of claim 10 comprising the further steps of:

a. positioning said arms randomly on said side sections to extend in varied vertically tilted staggered projection into the pathway, and b. inflating said arms to different pressures along the pathway to provide different resistances to passage of the runner along the pathway.

12. The method of claim 10 comprising the further steps of:

a. providing the arms with detachable mounts for front to rear sliding and rotatable adjustment on said side frames; and b. moving the mounts to adjusted rotary and lengthwise positions on said side frames.

13. The method of claim 12 wherein the detachable mounts include releasable interlocking parts, and comprising the further steps of:

a. releasing said interlocking parts; and b. removing and replacing said arms.

* * * * *